US010309240B2

(12) United States Patent
Heitman et al.

(10) Patent No.: US 10,309,240 B2
(45) Date of Patent: Jun. 4, 2019

(54) METHOD AND SYSTEM FOR INTERFACING A CERAMIC MATRIX COMPOSITE COMPONENT TO A METALLIC COMPONENT

(71) Applicant: General Electric Company, Schenectady, NY (US)

(72) Inventors: Bryce Loring Heitman, Cincinnati, OH (US); Darrell Glenn Senile, Oxford, OH (US); Michael Ray Tuertscher, Fairfield, OH (US); Greg Scott Phelps, Cincinnati, OH (US); Brian Gregg Feie, Cincinnati, OH (US); Steven James Murphy, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 840 days.

(21) Appl. No.: 14/808,000

(22) Filed: Jul. 24, 2015

(65) Prior Publication Data

US 2017/0022833 A1 Jan. 26, 2017

(51) Int. Cl.
*F01D 9/04* (2006.01)
*F01D 25/00* (2006.01)
(Continued)

(52) U.S. Cl.
CPC ..... *F01D 9/041* (2013.01); *F01D 5/284* (2013.01); *F01D 9/042* (2013.01); *F01D 25/005* (2013.01);
(Continued)

(58) Field of Classification Search
CPC ... F01D 9/02; F01D 9/04; F01D 9/041; F01D 9/042; F01D 5/18; F01D 5/282;
(Continued)

(56) References Cited

U.S. PATENT DOCUMENTS 3,070,352 A 12/1962 Welsh
4,126,405 A * 11/1978 Bobo ..... F01D 9/042 415/115
(Continued)

FOREIGN PATENT DOCUMENTS

CN 104246134 A 12/2014
EP 2733308 A2 5/2014
(Continued)

OTHER PUBLICATIONS

A European Search Report and Opinion issued in connection with corresponding EP Application No. 16178858.3 dated Dec. 15, 2016.
(Continued)

*Primary Examiner* — Woody Lee, Jr.
*Assistant Examiner* — Elton Wong
(74) *Attorney, Agent, or Firm* — General Electric Company; William Andes

(57) ABSTRACT

An airfoil assembly for a gas turbine engine and a method of transferring load from the ceramic matrix composite (CMC) airfoil assembly to a metallic vane assembly support member are provided. The airfoil assembly includes a forward end and an aft end with respect to an axial direction of the gas turbine engine. The airfoil assembly includes a radially outer end component, a radially inner end component, and a hollow airfoil body extending therebetween. The radially outer end component including a radially outwardly-facing end surface having a non-compression load-bearing feature extending radially outwardly and formed integrally with the outer end component, the load-bearing feature configured to mate with a complementary feature formed in a radially inner surface of a first airfoil assembly support structure and selectively positioned orthogonally to a force imparted into the airfoil assembly.

24 Claims, 16 Drawing Sheets

(51) Int. Cl.
*F01D 25/24* (2006.01)
*F01D 5/28* (2006.01)
*F01D 5/18* (2006.01)

(52) U.S. Cl.
CPC ..... *F01D 25/243* (2013.01); *F01D 5/18* (2013.01); *F05D 2220/32* (2013.01); *F05D 2240/128* (2013.01); *F05D 2260/30* (2013.01); *F05D 2260/941* (2013.01); *F05D 2300/6033* (2013.01)

(58) Field of Classification Search
CPC ..... F01D 5/284; F01D 25/005; F01D 25/243; F01D 25/246; F05D 2260/941; F05D 2300/6033
See application file for complete search history.

(56) References Cited

U.S. PATENT DOCUMENTS 4,214,851 A * 7/1980 Tuley ..... F01D 5/18 415/115
4,907,946 A 3/1990 Ciokajlo et al.
5,022,818 A 6/1991 Scalzo
6,000,906 A 12/1999 Draskovich
7,114,917 B2 10/2006 Legg
7,410,345 B2 8/2008 Bracken
7,645,117 B2 1/2010 Bracken et al.
8,133,019 B2 3/2012 Kasperski
8,292,580 B2 10/2012 Schiavo et al.
8,894,370 B2 11/2014 Wassynger et al.
2002/0127097 A1* 9/2002 Darolia ..... F01D 5/3084 415/137
2006/0171812 A1* 8/2006 Albrecht ..... F01D 5/147 416/190
2010/0068034 A1* 3/2010 Schiavo ..... F01D 5/189 415/115
2011/0008156 A1* 1/2011 Prentice ..... F01D 5/282 415/200
2013/0101422 A1 4/2013 Bullinger et al.
2014/0001285 A1* 1/2014 Grooms, III ..... F01D 5/18 239/265.11
2014/0234118 A1 8/2014 Beaujard et al.
2016/0084096 A1* 3/2016 Carr ..... F01D 9/041 60/805

FOREIGN PATENT DOCUMENTS

EP 3000979 A1 3/2016
JP S61-66802 A 4/1986
JP 2000-320497 A 11/2000
JP 2002-021505 A 1/2002
JP 2004-076601 A 3/2004
JP 3701680 B2 10/2005
JP 2009-041568 A 2/2009
JP 2011-508151 A 3/2011
JP 2012-519803 A 8/2012
JP 2014-088786 A 5/2014

OTHER PUBLICATIONS

U.S. Appl. No. 14/574,472, filed Dec. 18, 2014, entitled "Ceramic Matrix Composite Nozzle Mounted With a Strut and Concepts Thereof."
Machine Translation and First Office Action and Search issued in connection with corresponding CN Application No. 201610581509.9 dated May 12, 2017.
Machine Translation and Notification of Reasons for Refusal issued in connection with corresponding JP Application No. 2016-139002 dated Aug. 1, 2017.

* cited by examiner

METHOD AND SYSTEM FOR INTERFACING A CERAMIC MATRIX COMPOSITE COMPONENT TO A METALLIC COMPONENT

BACKGROUND

This description relates to a composite nozzle assembly, and, more particularly, to a method and system for interfacing a ceramic matrix composite component to a metallic component in a gas turbine engine.

At least some known gas turbine engines include a core having a high pressure compressor, combustor, and high pressure turbine (HPT) in serial flow relationship. The core engine is operable to generate a primary gas flow. The high pressure turbine includes annular arrays ("rows") of stationary vanes or nozzles that direct the gases exiting the combustor into rotating blades or buckets. Collectively one row of nozzles and one row of blades make up a "stage". Typically two or more stages are used in serial flow relationship. These components operate in an extremely high temperature environment, and may be cooled by air flow to ensure adequate service life.

HPT nozzles are often configured as an array of airfoil-shaped vanes extending between annular inner and outer bands which define the primary flowpath through the nozzle. Due to operating temperatures within the gas turbine engine, materials having a low coefficient of thermal expansion are used. For example, to operate effectively in such adverse temperature and pressure conditions, ceramic matrix composite (CMC) materials may be used. These low coefficient of thermal expansion materials have higher temperature capability than similar metallic parts, so that, when operating at the higher operating temperatures, the engine is able to operate at a higher engine efficiency. However, such ceramic matrix composite (CMC) have mechanical properties that must be considered during the design and application of the CMC. CMC materials have relatively low tensile ductility or low strain to failure when compared to metallic materials. Also, CMC materials have a coefficient of thermal expansion which differs significantly from metal alloys used as restraining supports or hangers for CMC type materials. Therefore, if a CMC component is restrained and cooled on one surface during operation, stress concentrations can develop leading to a shortened life of the segment.

To date nozzles formed of CMC materials have experienced localized stresses that have exceeded the capabilities of the CMC material, leading to a shortened life of the nozzle. The stresses have been found to be due to moment stresses imparted to the nozzle and associated attachment features, differential thermal growth between parts of differing material types, and loading in concentrated paths at the interface between the nozzle and the associated attachment features.

BRIEF DESCRIPTION

In one embodiment, an airfoil assembly for a gas turbine engine is formed of a ceramic matrix composite (CMC) material and includes a forward end and an aft end with respect to an axial direction of the gas turbine engine. The airfoil assembly further includes a radially outer end component including a radially outwardly-facing end surface having a non-compression load-bearing feature extending radially outwardly from the outwardly-facing end surface and formed integrally with the outer end component. The feature is configured to mate with a complementary feature formed in a radially inner surface of a first airfoil assembly support structure. The feature is selectively positioned orthogonal to a force imparted into the airfoil assembly. The airfoil assembly also includes a radially inner end component, and a hollow airfoil body extending between the inner and outer end components. The airfoil body is configured to receive a strut couplable at a first end to the first airfoil assembly support structure.

In another embodiment, a method of transferring load from a ceramic matrix composite (CMC) vane assembly to a metallic vane assembly support member includes providing the CMC vane assembly wherein the vane assembly includes a radially outer end component including a radially outwardly facing surface having one or more radially outwardly extending load transfer features. The vane assembly further includes, a radially inner end component, and an airfoil body extending between the inner and outer end components. The method further includes engaging the radially outer end component to at least one of a plurality of metallic vane assembly support members spaced circumferentially about a gas flow path. The vane assembly support members including one or more load receiving features shaped complementary to the load transfer features. The load transfer feature includes a wedge-shaped cross-section.

In yet another embodiment, a gas turbine engine includes an inner support structure formed of a first metallic material, the inner support structure including a strut, the strut including a first mating end, a second opposing mating end and a strut body extending radially between the first mating end and the second mating end. The gas turbine engine further includes an outer support structure formed of a second metallic material and an airfoil assembly including a ceramic matrix composite (CMC) material and extending between the inner support structure and the outer support structure. The airfoil assembly includes a radially outer end component including a radially outwardly-facing end surface having a non-compression load-bearing feature extending radially outwardly from the outwardly-facing end surface and formed integrally with the outer end component. The feature is configured to mate with a complementary feature formed in a radially inner surface of the outer support structure. The feature is selectively positioned orthogonally to a force imparted into the radially outwardly-facing end surface. The airfoil assembly also includes a radially inner end component, and a hollow airfoil body extending between the radially outer end component and radially inner end component. The airfoil body is configured to receive a strut couplable at a first end to the outer support structure.

BRIEF DESCRIPTION OF THE DRAWINGS

FIG. 1 is a schematic illustration of an exemplary gas turbine engine.

FIG. 2 is a perspective view of a nozzle ring in accordance with an example embodiment of the present disclosure.

FIG. 3 is a partially exploded view of nozzle segment assemblies in accordance with an example embodiment of the present disclosure from a forward perspective looking aft.

FIG. 4 is another partially exploded view of nozzle segment assemblies also from a forward perspective looking aft.

FIG. 5 is a perspective view of nozzle segment assembly including radially outwardly-facing end surface.

FIG. 6 is a perspective view of another embodiment of nozzle segment assembly including radially outwardly-facing end surface.

FIG. 7 is a perspective view of another embodiment of nozzle segment assembly including radially outwardly-facing end surface.

FIG. 8 is a perspective view of nozzle segment assembly as shown in FIG. 7 mated to outer band using tab and a boss formed in outer band.

FIG. 9 is a perspective view of another embodiment of nozzle segment assembly including radially outwardly-facing end surface.

FIG. 10 is a perspective view of another embodiment of nozzle segment assembly including radially outwardly-facing end surface.

FIG. 11 is a perspective view of another embodiment of nozzle segment assembly including radially outwardly-facing end surface.

FIG. 12 is a perspective view of another embodiment of nozzle segment assembly including radially outwardly-facing end surface.

FIG. 13 is a perspective view of another embodiment of nozzle segment assembly including radially outwardly-facing end surface.

Figure 1:
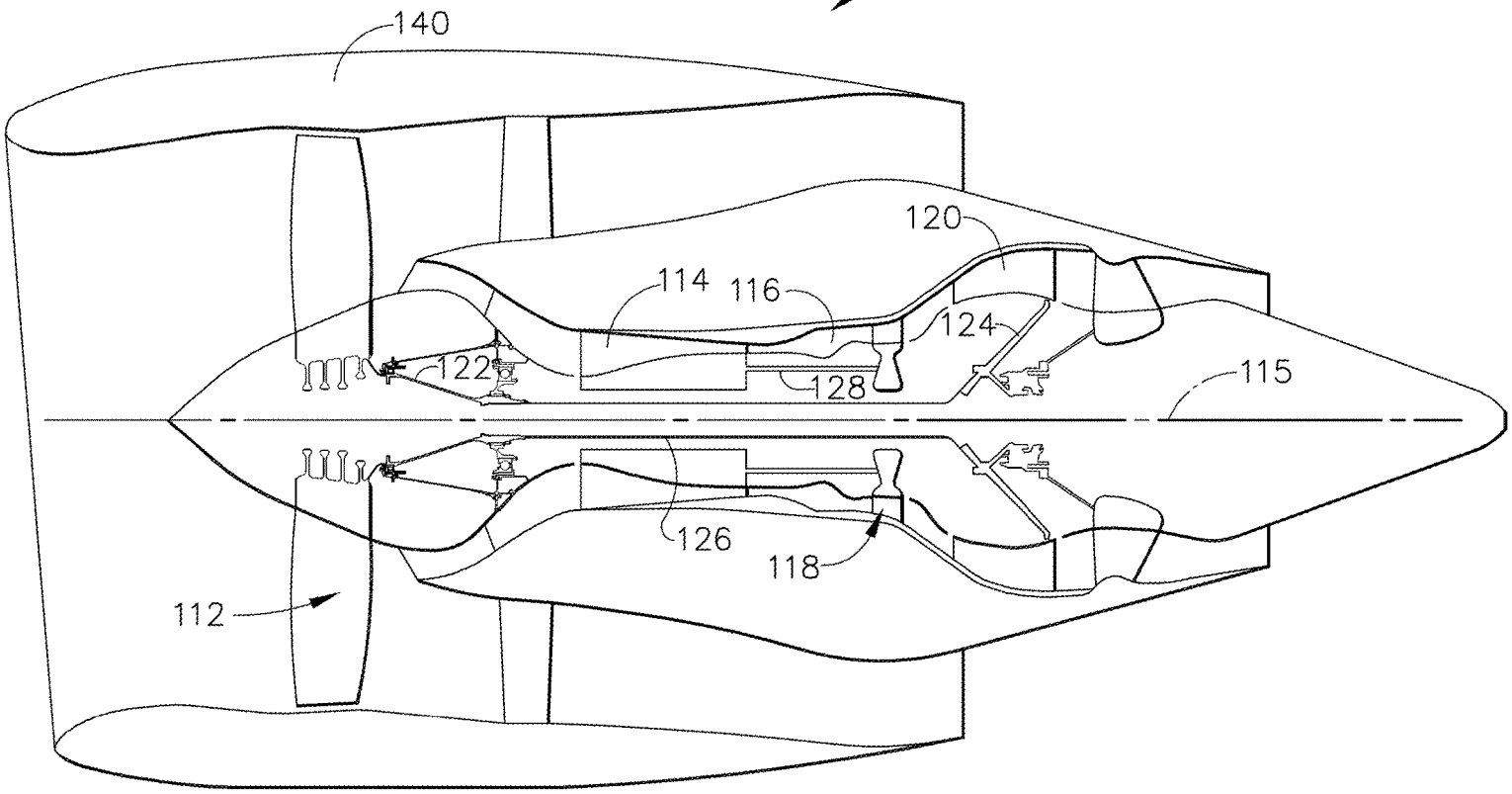
FIGS. 1-13 show example embodiments of the method and apparatus described herein.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

Embodiments of this disclosure describe nozzle segment assemblies that include an airfoil extending between inner and outer bands that are formed of a composite matrix material (CMC). The CMC material has a temperature coefficient of expansion that is different than the hardware used to support the CMC nozzle segment assemblies. Moreover, the CMC has material properties that tend to limit its ability to withstand forces in certain directions, for example, in a tensile direction or directions in which a tensile component is present, such as, but not limited to twisting or bending directions.

To interface the CMC nozzle segment assemblies to their respective support structure, which is metallic, new structures are described which permit the CMC nozzle segment assemblies to withstand the high temperature and hostile environment in a gas turbine engine turbine flow path.

The following detailed description illustrates embodiments of the disclosure by way of example and not by way of limitation. It is contemplated that the disclosure has general application to analytical and methodical embodiments of transmitting loads from one component to another.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As used herein, the terms "axial" or "axially" refer to a dimension along a longitudinal axis of an engine. The term "forward" used in conjunction with "axial" or "axially" refers to moving in a direction toward the engine inlet, or a component being relatively closer to the engine inlet as compared to another component. The term "aft" used in conjunction with "axial" or "axially" refers to moving in a direction toward the rear of the engine.

As used herein, the terms "radial" or "radially" refer to a dimension extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The following description refers to the accompanying drawings, in which, in the absence of a contrary representation, the same numbers in different drawings represent similar elements.

FIG. 1 is a schematic illustration of an exemplary gas turbine engine 100. Engine 100 includes a low pressure compressor 112, a high pressure compressor 114, and a combustor assembly 116. Engine 100 also includes a high pressure turbine 118, and a low pressure turbine 120 arranged in a serial, axial flow relationship on respective rotors 122 and 124. Compressor 112 and turbine 120 are coupled by a first shaft 126, and compressor 114 and turbine 118 are coupled by a second shaft 128.

During operation, air flows along a central axis 115, and compressed air is supplied to high pressure compressor 114. The highly compressed air is delivered to combustor 116. Exhaust gas flow (not shown in FIG. 1) from combustor 116 drives turbines 118 and 120, and turbine 120 drives fan or low pressure compressor 112 by way of shaft 126. Gas turbine engine 100 also includes a fan or low pressure compressor containment case 140.

Figure 2:
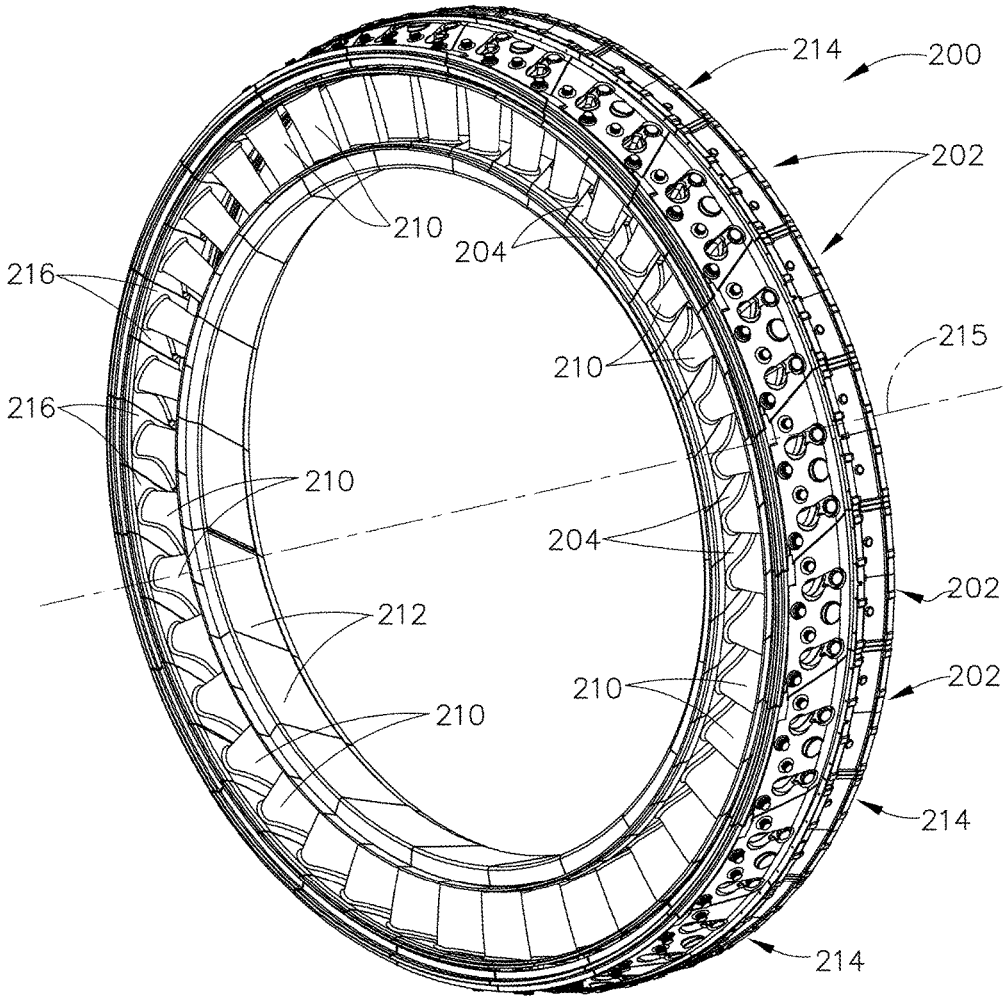

FIG. 2 is a perspective view of a nozzle ring 200 in accordance with an example embodiment of the present disclosure. In the example embodiment, nozzle ring 200 may be located within high pressure turbine 118 and/or low pressure turbine 120 (shown in FIG. 1). Nozzle ring 200 is formed of one or more nozzle segment assemblies 202. Nozzle segment assemblies 202 direct combustion gases downstream through a subsequent row of rotor blades (not shown) extending radially outwardly from supporting rotor 122 or 124 (shown in FIG. 1). Nozzle ring 200 and plurality of nozzle segment assemblies 202 defining nozzle ring 200 facilitate extracting energy by rotor 122 or 124 (shown in FIG. 1). Additionally, nozzle ring 200 may be used in high pressure compressor 114 which may be either of a high pressure or low pressure compressor. Segment assemblies 202 include an inner band 204 and an outer band 216 and a plurality of struts 208 (not shown in FIG. 2) extending through nozzle airfoils 210. Inner band 204 and outer band 216 extend circumferentially 360 degrees about engine axis 115.

Nozzle ring 200 is formed of a plurality of nozzle segment assemblies 202 each of which includes an inner support structure 212, at least one nozzle airfoil 210 and a hanger or outer band 216. Strut 208 carries load from the radially inward side of nozzle segment assembly 202 at inner support structure 212 to the radially outward side at outer band 216 where load is transferred to a structure of engine 100, such as, but not limited to a casing of engine 100 and mechanically supports nozzle airfoil 210. Strut 208 may be connected to at least one of inner support structure 212 and outer band 216 by, for example, but not limited to, bolting, fastening, capturing, combinations thereof and being integrally formed.

Figure 3:
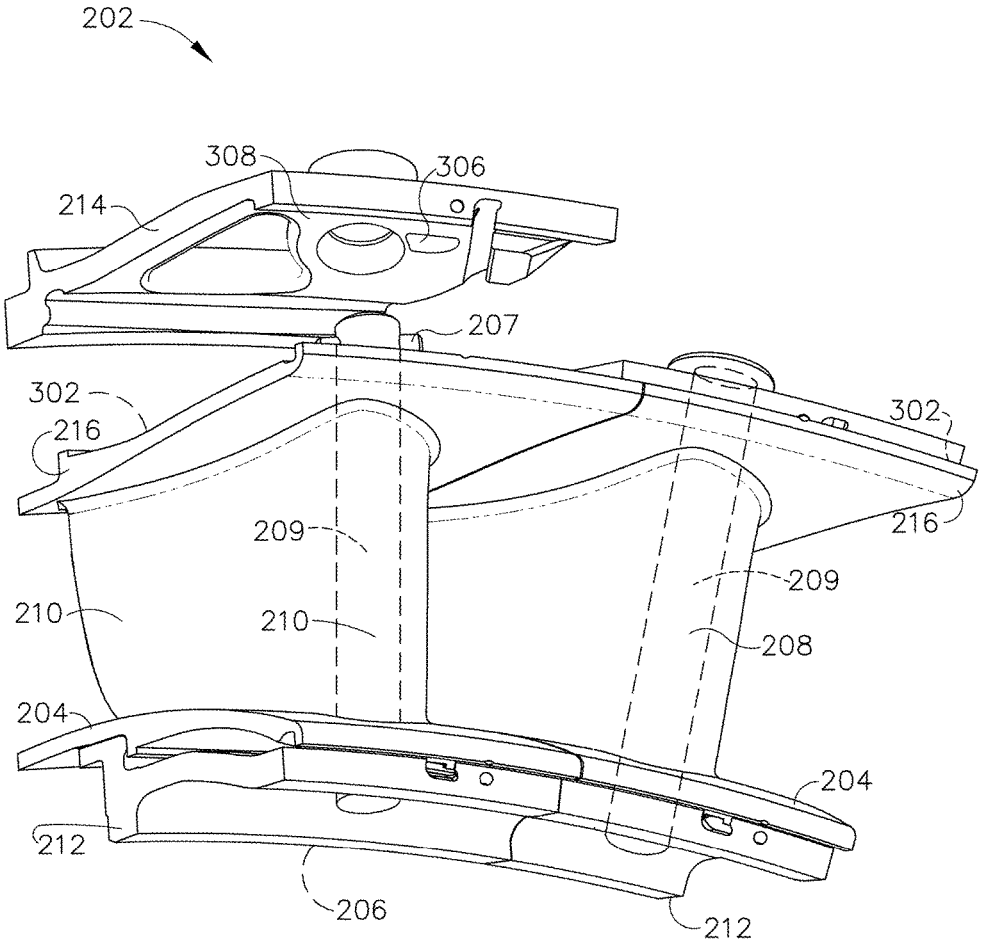
Figure 4:
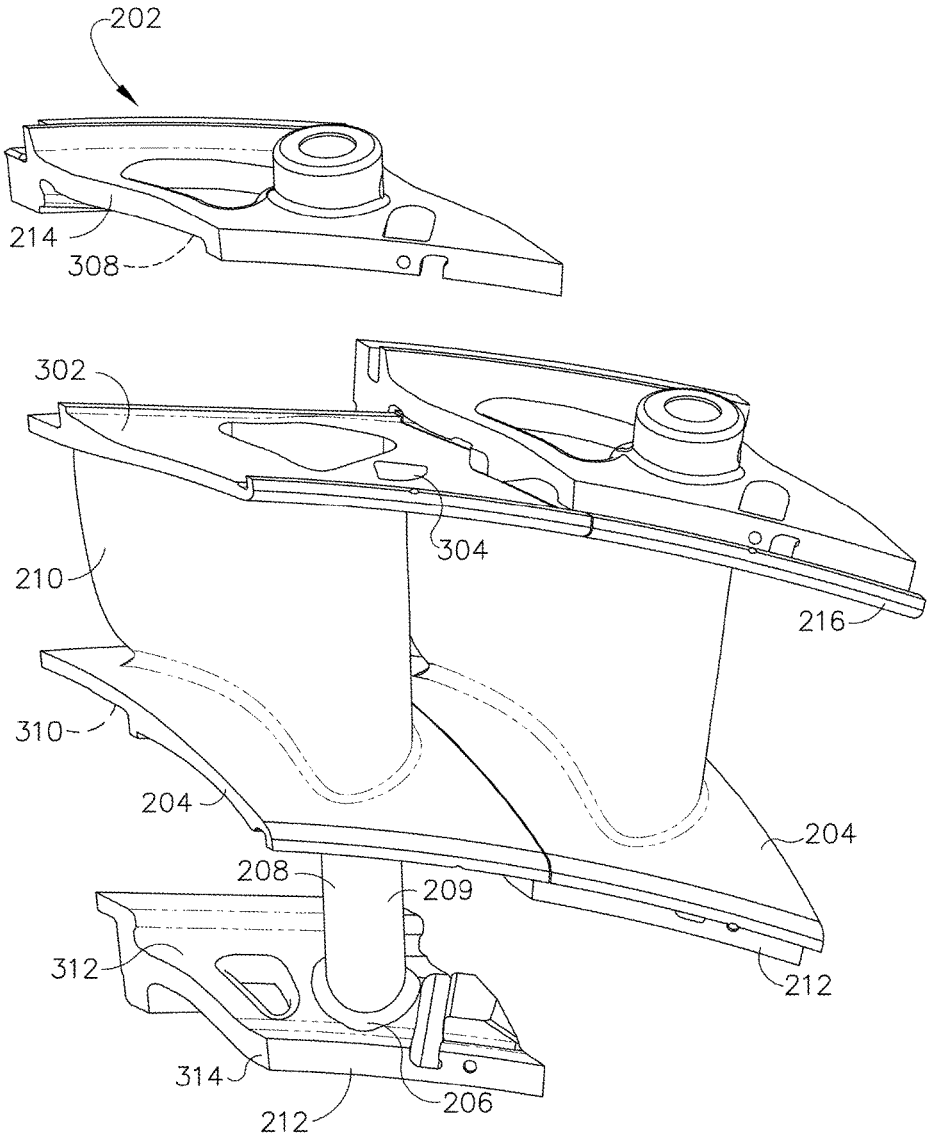

FIG. 3 is a partially exploded view of nozzle segment assemblies 202 in accordance with an example embodiment of the present disclosure from a forward perspective looking aft. FIG. 4 is another partially exploded view of nozzle segment assemblies 202 also from a forward perspective looking aft. In the example embodiment, nozzle segment assembly 202 includes an inner support structure 212 formed of a first metallic material. Inner support structure 212 includes a strut 208 that is couplable to inner support structure 212, is formed integrally with inner support structure 212, or may be coupled to inner support structure 212 during assembly of nozzle segment assembly 202. Strut 208 may be hollow and may each have at least one internal wall to enhance a stiffness of strut 208. Strut 208 includes a first mating end 206 (hidden by inner support structure 212 in FIGS. 3 and 4), a second opposing mating end 207, and a strut body 209 extending radially therebetween. In the example embodiment, strut body 209 is cylindrically-shaped. In various embodiments, strut body 209 has non-circular cross-section, for example, but, not limited to, oval, oblong, polygonal, or combinations thereof. Nozzle segment assembly 202 also includes a radially outer band 216 formed of a second metallic material. In the example embodiment, the first and second metallic material are the same material such as, but not limited to a nickel-based superalloy, an intermetallic material such as gamma titanium aluminide, or other alloy that exhibits resistance to high temperatures. Inner support structure 212, outer band 216, strut 208, and other metallic components of the assembly may all be formed of the same material or may be formed of different materials that are able to perform the functions described herein.

Nozzle airfoil 210 is formed of a material having a low coefficient of thermal expansion, such as for example, ceramic matrix composite (CMC) material. Nozzle airfoil 210 extends between inner band 204 and outer band 216. Outer band 216 includes a radially outwardly-facing end surface 302 having a non-compression load-bearing feature 304 extending radially outwardly from outwardly-facing end surface 302 and formed integrally with outer band 216. Feature 304 is configured to mate with a complementary feature 306 formed in a radially inner surface 308 of outer support structure 214. Feature 304 is selectively positioned orthogonally to a force imparted into nozzle airfoil 210. In various embodiments, inner band 204 includes a radially inwardly-facing end surface 310 having a non-compression load-bearing feature (not shown) extending radially inwardly from radially inwardly-facing end surface 310 and formed integrally with inner band 204. The feature extending from radially inwardly-facing end surface 310 is configured to mate with a complementary feature 312 formed in a radially outer surface 314 of inner band 204.

Figure 5:
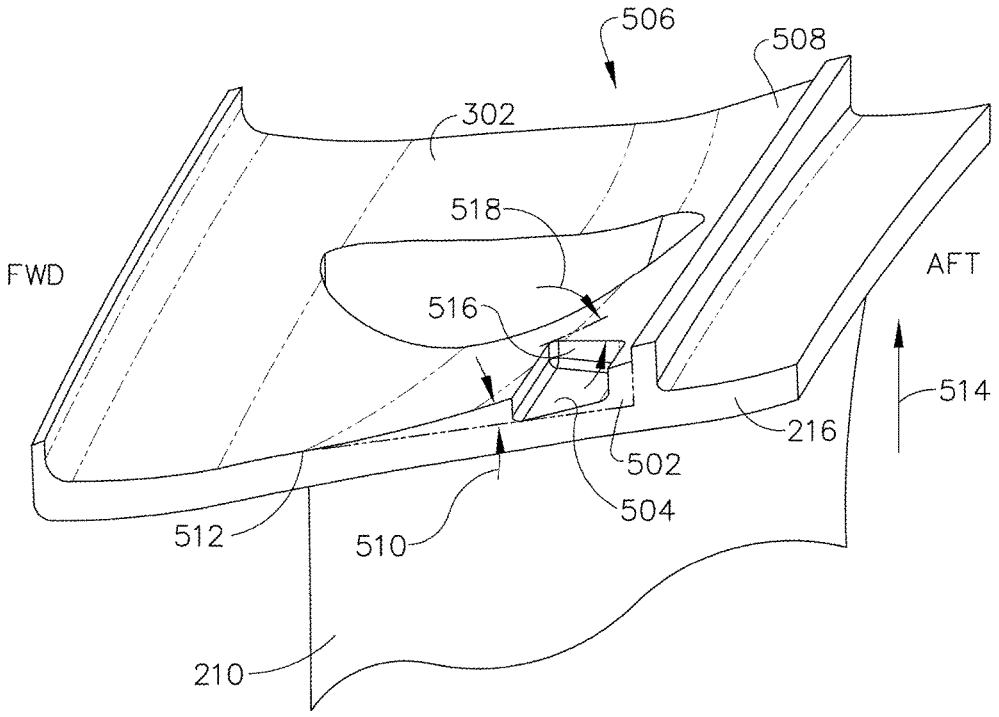

FIG. 5 is a perspective view of nozzle segment assembly 202 including radially outwardly-facing end surface 302. In the example embodiment, non-compression load-bearing feature 304 is embodied in a wedge flange 502 that includes a whistle notch 504. Wedge flange 502 includes a built-up area 506 along an aft side 508 of surface 302. Wedge flange 502 increases in thickness 510 from a forward starting point 512 towards aft side 508. Wedge flange 502 is formed of CMC during a layup phase of manufacturing and is therefore an integral extension of surface 302 in an outward radial direction 514. In various embodiments, notch 504 is formed by machining surface 302 during manufacturing. Alternatively, notch 504 is formed during the layup phase. Notch 504 is configured to a complementarily-shaped feature (not shown) extending radially inwardly from radially inner surface 308 of inner support structure 212. A face 516 of notch 504 is configured to receive a tangential load from the feature (not shown) extending radially inwardly from radially inner surface 308. Face 516 may be oriented axially, as illustrated, or may be oriented at a positive or negative angle 518 with respect to axis 15 (shown in FIG. 1) to receive loads that are not only tangential, but that also include an axial component.

Figure 6:
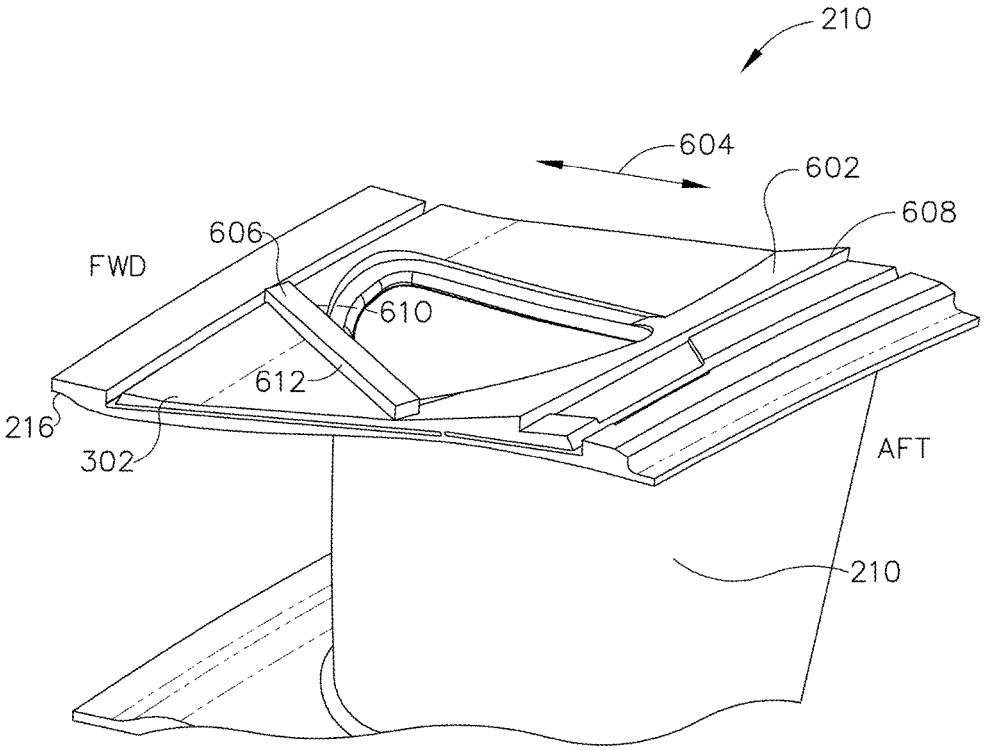

FIG. 6 is a perspective view of another embodiment of nozzle segment assembly 202 including radially outwardly-facing end surface 302. In the example embodiment, two non-compression load-bearing features 304 are embodied in an axial wedge flange 602 that is oriented orthogonally to an axial direction 604 and a tangential flange 606. Axial wedge flange 602 includes a face 608 oriented towards axial direction 604 and is configured to transmit axially-oriented loads to a complementarily-shaped feature (not shown) extending radially inwardly from radially inner surface 308 of inner support structure 212. In the example embodiment, tangential flange 606 includes a rectangular cross-section and a first face 610 and a second face 612 configured to transmit loads with a tangential component to a complementarily-shaped feature (not shown) extending radially inwardly from radially inner surface 308 of inner support structure 212. A relative orientation and position of axial wedge flange 602 and tangential flange 606 are selected based on determined forces that will be generated in nozzle airfoil 210 during operation.

Figure 7:
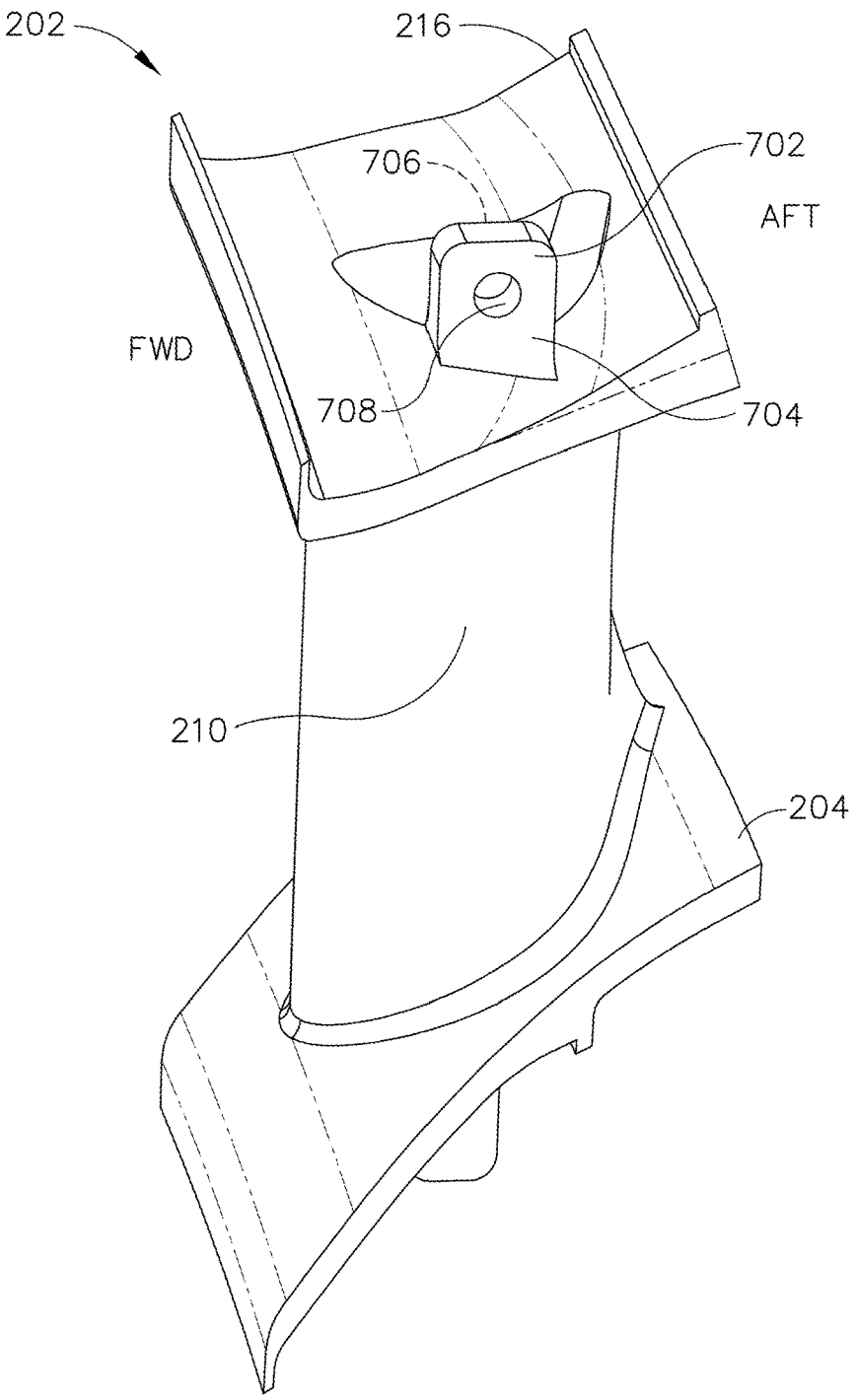

FIG. 7 is a perspective view of another embodiment of nozzle segment assembly 202 including radially outwardly-facing end surface 302. In the example embodiment, non-compression load-bearing feature 304 is embodied in a radially outwardly extending tab 702. Tab 702 includes a first face 704 and an opposing second face 706. An aperture 708 is configured to receive a pin (not shown in FIG. 7). Faces 704 and 706 are positioned such that a load is transmitted orthogonally to faces 704 and 706. Tab 702 is configured to be received in a complementarily-shaped boss (not shown in FIG. 7) extending from radially inner surface 308 of outer band 216. In some embodiments, the boss also includes one or more apertures aligned with aperture 708 when nozzle segment assembly 202 is assembled to for example, outer band 216. A pin (not shown in FIG. 7) inserted through aperture 708 and the apertures in the boss permit transfer of radial loads to outer band 216 through the pin (not shown in FIG. 7).

Figure 8:
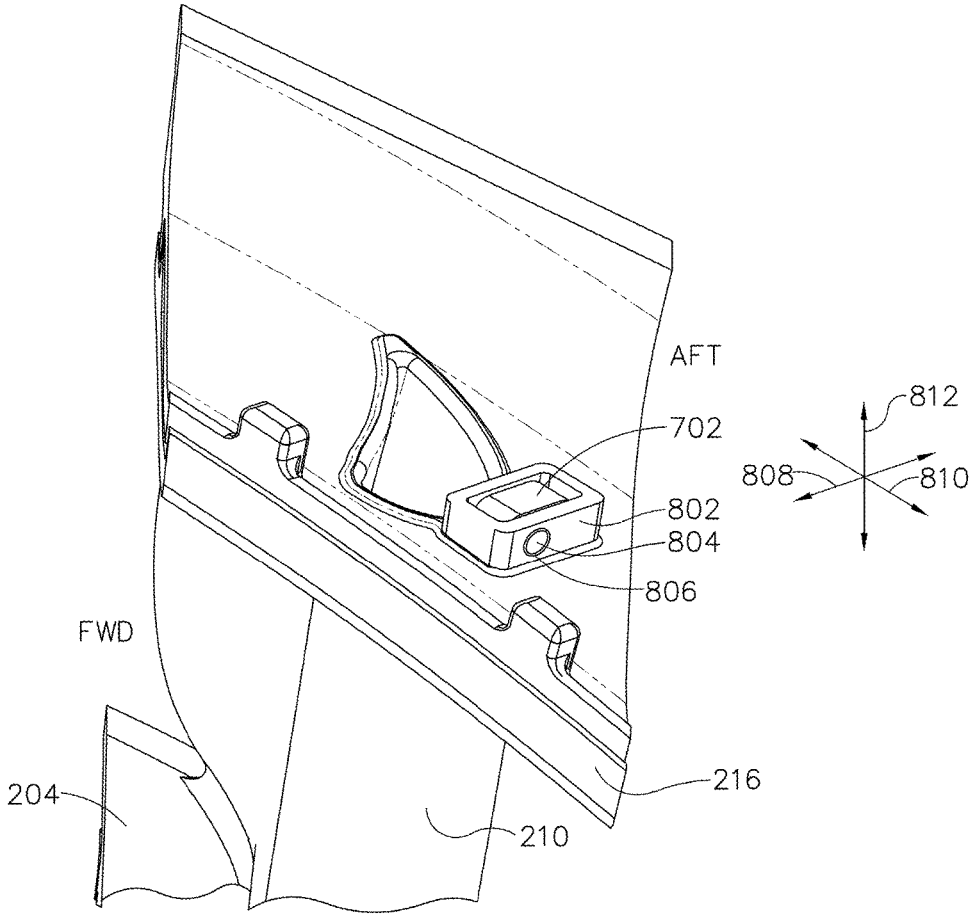

FIG. 8 is a perspective view of nozzle segment assembly 202 as shown in FIG. 7 mated to outer band 216 using tab 702 and a boss 802 formed in outer band 216. In the example embodiment, a pin 804 is optionally inserted through aperture 708 (shown in FIG. 7) and one or more apertures 806 in boss 802. Tab 702, boss 802, and pin 804 are configured to transmit and receive loads in an axial direction 808, a tangential direction 810, and a radial direction 812. Faces of tab 702, boss 802, and pin 804 may be squarely aligned in axial direction 808 and tangential direction 810 or may be aligned at an angle with respect to axial direction 808 and tangential direction 810 to transmit loads having axial and tangential components.

Figure 9:
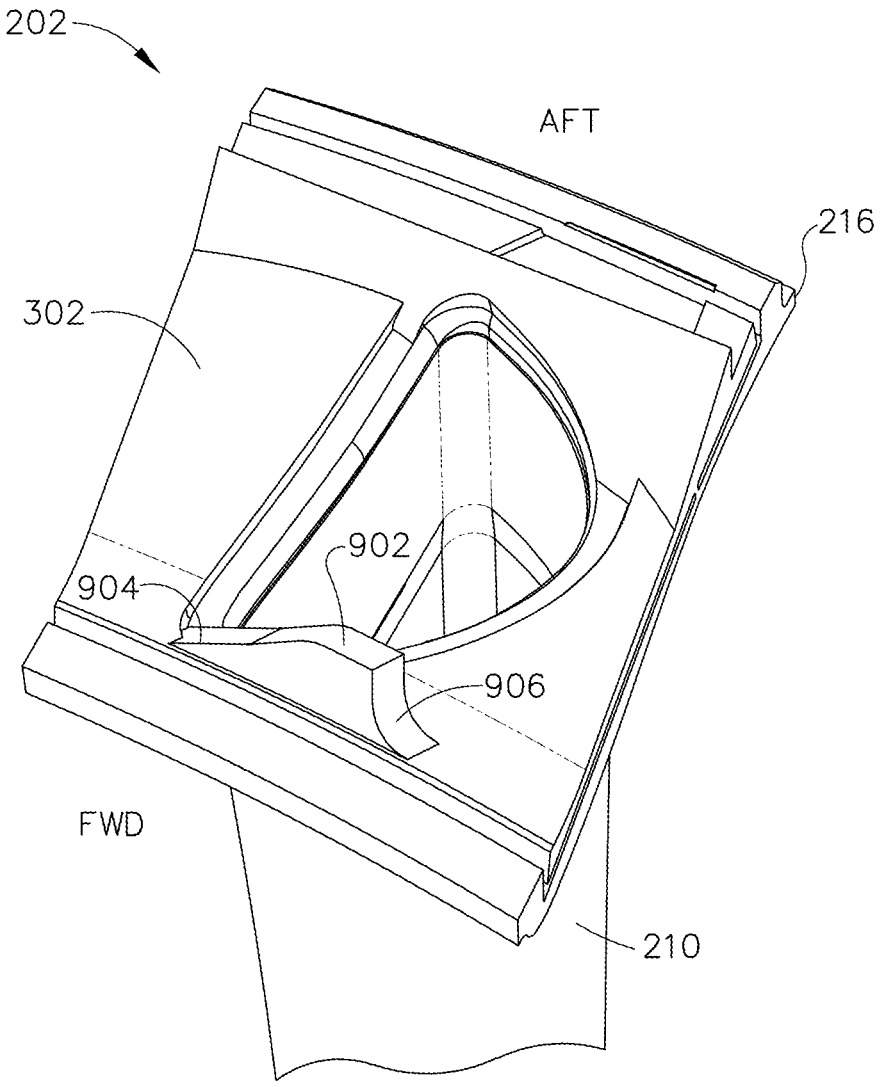

FIG. 9 is a perspective view of another embodiment of nozzle segment assembly 202 including radially outwardly-facing end surface 302. In the example embodiment, non-compression load-bearing feature 304 is embodied in a hook member 902 including a radially outwardly extending ramp portion 904 and an opposing concave portion 906. Hook member 902 is configured to mate with a complementarily-shaped feature formed in radially inner surface 308 of inner support structure 212.

Figure 10:
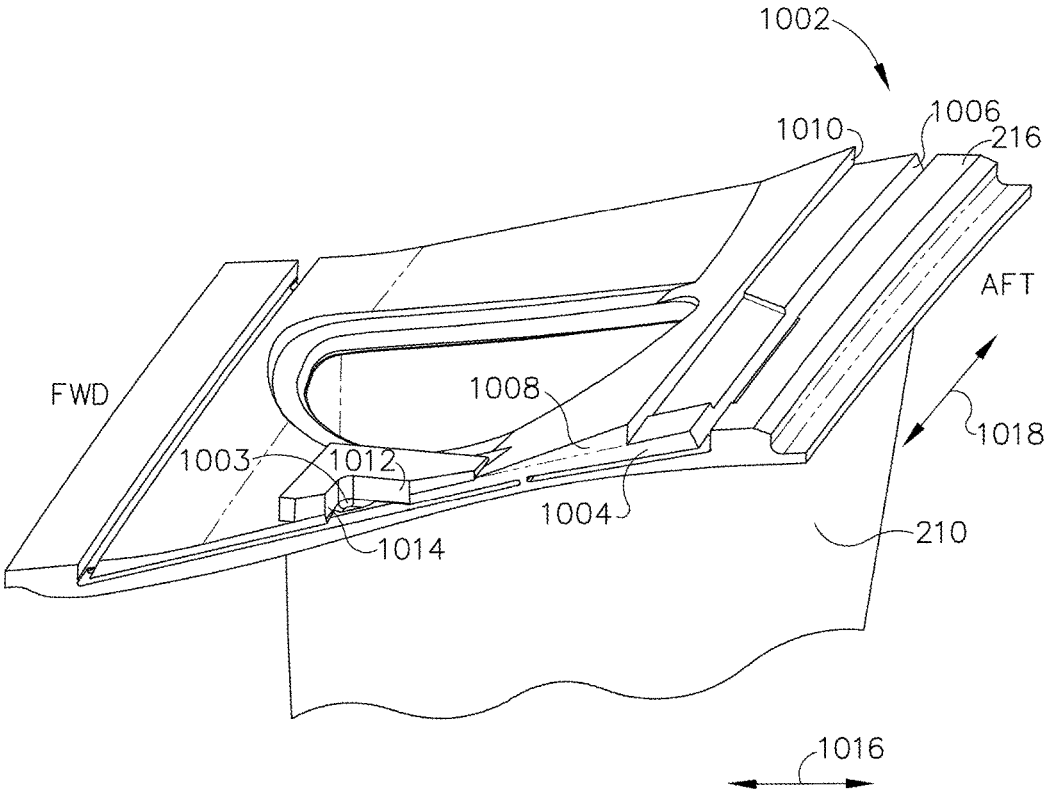

FIG. 10 is a perspective view of another embodiment of nozzle segment assembly 202 including radially outwardly-facing end surface 302. In the example embodiment, non-compression load-bearing feature 304 is embodied in a compound axial wedge flange 1002 in combination with a tangential notch 1003. Compound axial wedge flange 1002 includes a first wedge flange 1004 having a first axial face 1006 and a second wedge flange 1008 having a second axial face 1010. Tangential notch 1003 includes a tangential face 1012 and an axial face 1014. Each of faces 1003, 1006, and 1014 are configured to transmit a load in an axial direction 1016 to a complementarily-shaped feature extending from radially inner surface 308 (shown in FIG. 3) of outer band 216 (shown in FIG. 3). Face 1012 is configured to transmit a load in a tangential direction 1018 to a complementarily-shaped feature extending from radially inner surface 308 (shown in FIG. 3) of outer band 216 (shown in FIG. 3).

Figure 11:
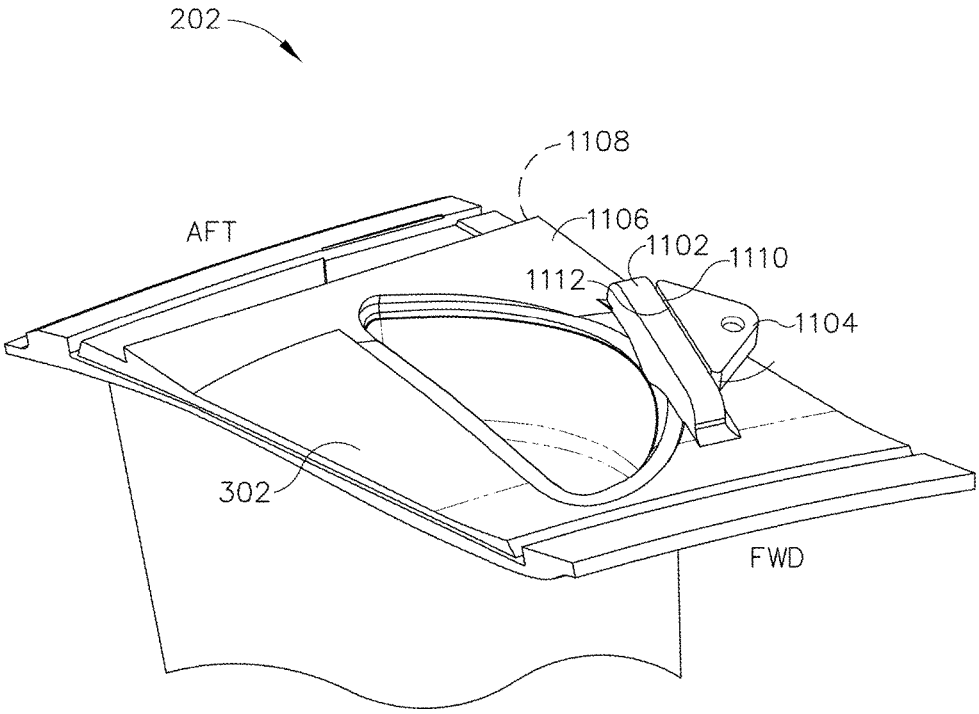

FIG. 11 is a perspective view of another embodiment of nozzle segment assembly 202 including radially outwardly-facing end surface 302. In the example embodiment, non-compression load-bearing feature 304 is embodied in a tangential flange 1102 that engages a tangential face loading pivot 1104. Tangential flange 1102 is similar to tangential flange 606 and in some embodiments is identical to tangential flange 606. In various embodiments, tangential face loading pivot 1104 is formed of metal and is pivotably coupled to, for example, a complementarily-shaped pin (not shown) extending from radially inner surface 308 (shown in FIG. 3) of outer band 216 (shown in FIG. 3). In the example embodiment, radially outwardly-facing end surface 302 also includes an axial wedge flange 1106 that includes an aft-facing axial face 1108. Axial wedge flange 1106 may be transmitting a strictly axial load through aft-facing axial face 1108 for, for example, sealing purposes. Because of a particular geometry between nozzle segment assembly 202 and adjacent nozzle segment assemblies 202 the load may not be able to be reduced to a strictly tangential load, tangential flange 1102 and tangential face loading pivot 1104 is used to interface across the entire surfaces of faces 1110 and 1112. If load were to twist to transmit from another direction, tangential face loading pivot 1104 would pivot to continue to spread the load across faces 1110 and 1112.

Figure 12:
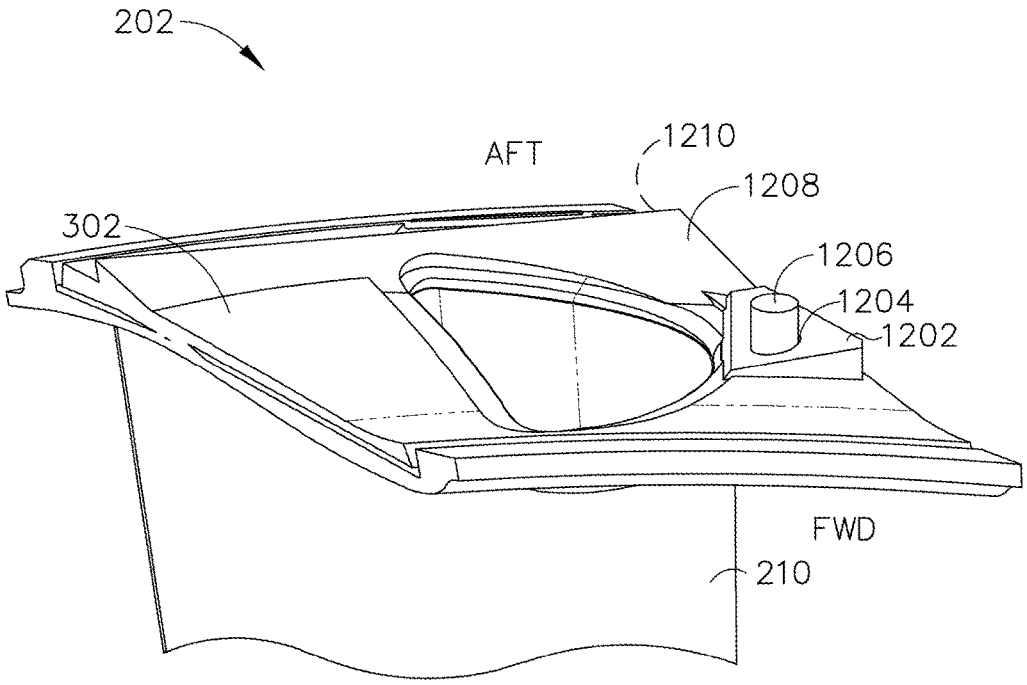

FIG. 12 is a perspective view of another embodiment of nozzle segment assembly 202 including radially outwardly-facing end surface 302. In the example embodiment, non-compression load-bearing feature 304 is embodied in a pin slot flange 1202, having a radially oriented pocket 1204 configured to engage a complementarily-shaped tangential pin 1206 extending from radially inner surface 308 (shown in FIG. 3) of outer band 216 (shown in FIG. 3). The combination of pin slot flange 1202 and tangential pin 1206 operates substantially similarly to tangential flange 1102 and tangential face loading pivot 1104 (both shown in FIG. 11). Pin slot flange 1202 and tangential pin 1206 may be selected for use in combination with an axial wedge flange 1208 that includes an aft-facing axial face 1210. In various embodiments, a plurality of pin slot flanges 1202 and tangential pins 1206 may be positioned and oriented to transmit all loads through surface 302. For example, combinations of pin slot flanges 1202 and tangential pins 1206 may be positioned at several locations on surface 302 and axial wedge flange 1208 not be used.

Figure 13:
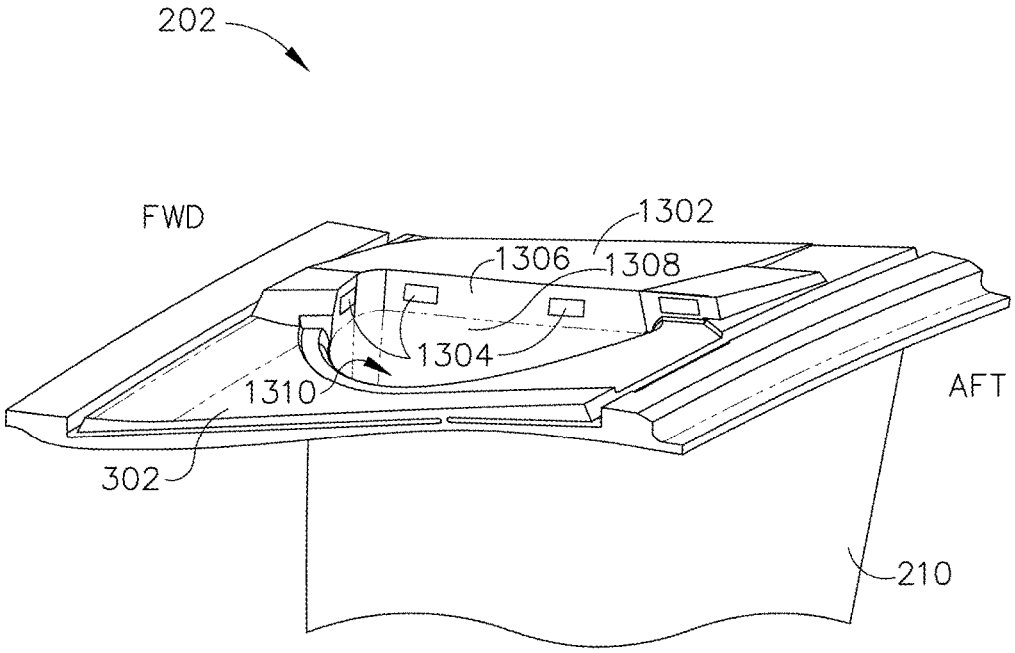

FIG. 13 is a perspective view of another embodiment of nozzle segment assembly 202 including radially outwardly-facing end surface 302. In the example embodiment, non-compression load-bearing feature 304 is embodied in a pressure-side wedge 1302. Pressure-side wedge 1302 includes a plurality of contact pads 1304. In the example embodiment, three contact pads 1304 are shown, however any number of contact pads may be used. Pressure-side wedge 1302 is positioned such that a tangential face 1306 coincides or overhangs a sidewall 1308 of an opening 1310 into a hollow interior of airfoil 210. Such a position permits easier machining of contact pads 1304 during fabrication. Pads 1304 are configured to a complementarily-shaped feature extending from radially inner surface 308 (shown in FIG. 3) of outer band 216 (shown in FIG. 3). In the example embodiment, pads 1304 are formed of CMC material and are machined to increase local wear resistance. In various embodiments, pads 1304 may be formed of a metal or other material different from CMC and machined into tangential face 1306. Tangential loads are transmitted through tangential face 1306 to outer band 216 (shown in FIG. 3).

Figure 14:
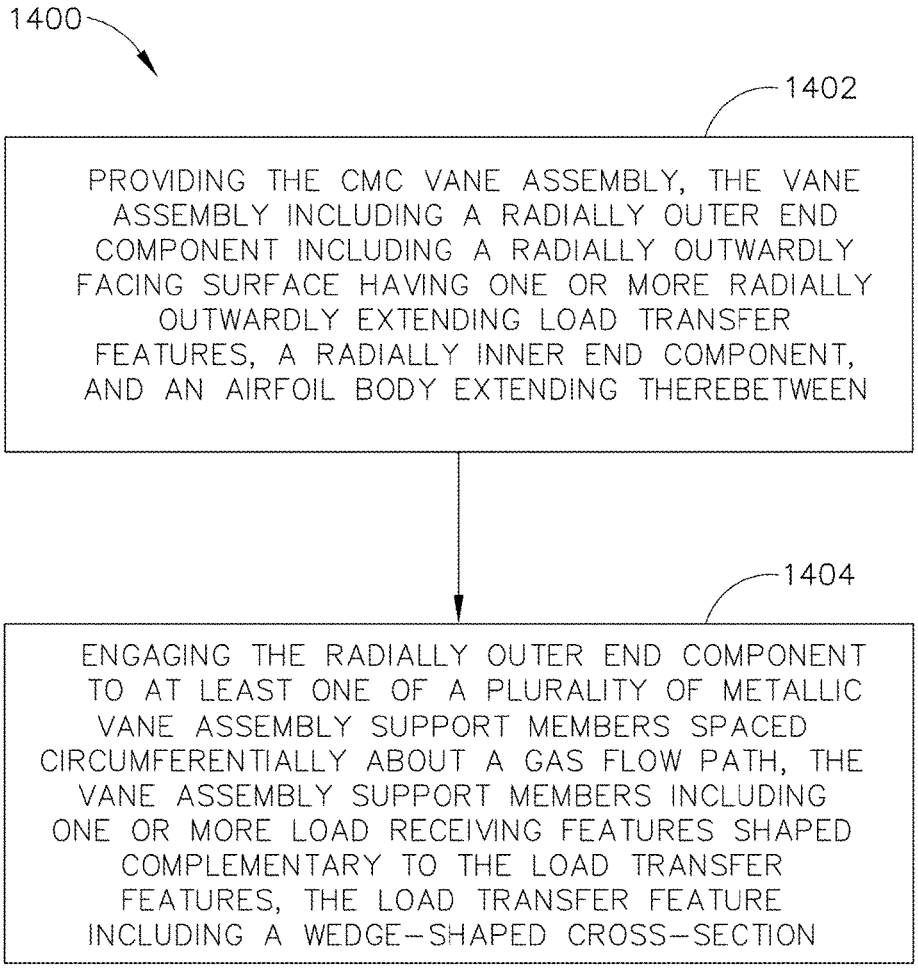
FIG. 14 is a flow diagram of a method of transferring load from a ceramic matrix composite (CMC) vane assembly to a metallic vane assembly support member.

FIG. 14 is a flow diagram of a method 1400 of transferring load from a ceramic matrix composite (CMC) vane assembly to a metallic vane assembly support member. In the example embodiment, method 1400 includes providing 1402 the CMC vane assembly wherein the CMC vane assembly includes a radially outer end component includes a radially outwardly facing surface having one or more radially outwardly extending load transfer features, a radially inner end component, and an airfoil body extending therebetween. Method 1400 also includes engaging 1404 the radially outer end component to at least one of a plurality of metallic vane assembly support members spaced circumferentially about a gas flow path. The vane assembly support members include one or more load receiving features shaped complementary to the load transfer features, the load transfer feature including a wedge-shaped cross-section.

Figure 15:
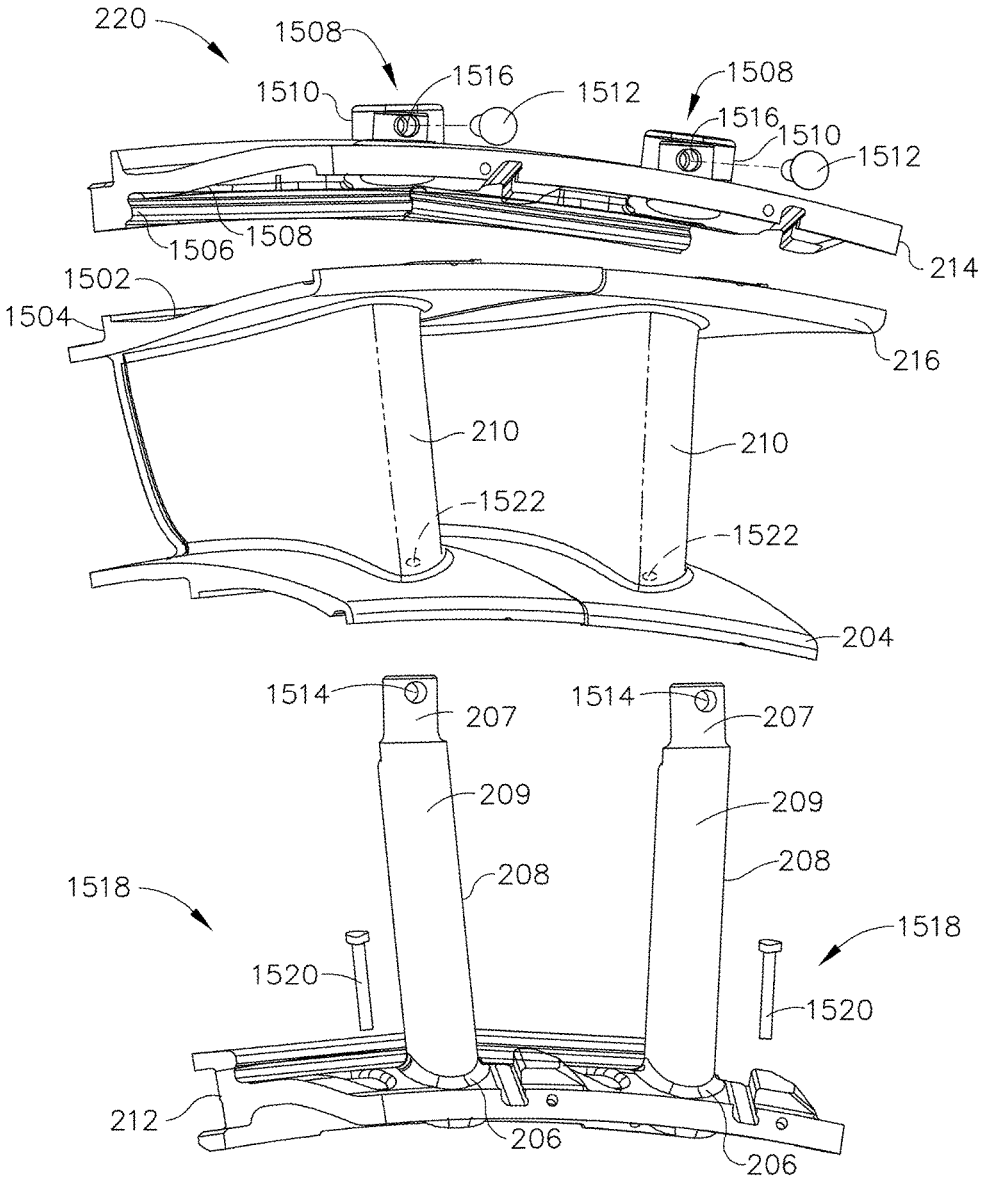
FIG. 15 is a partially exploded view of the nozzle segment assemblies in accordance with another example embodiment of the present disclosure from a forward perspective looking aft.
Figure 16:
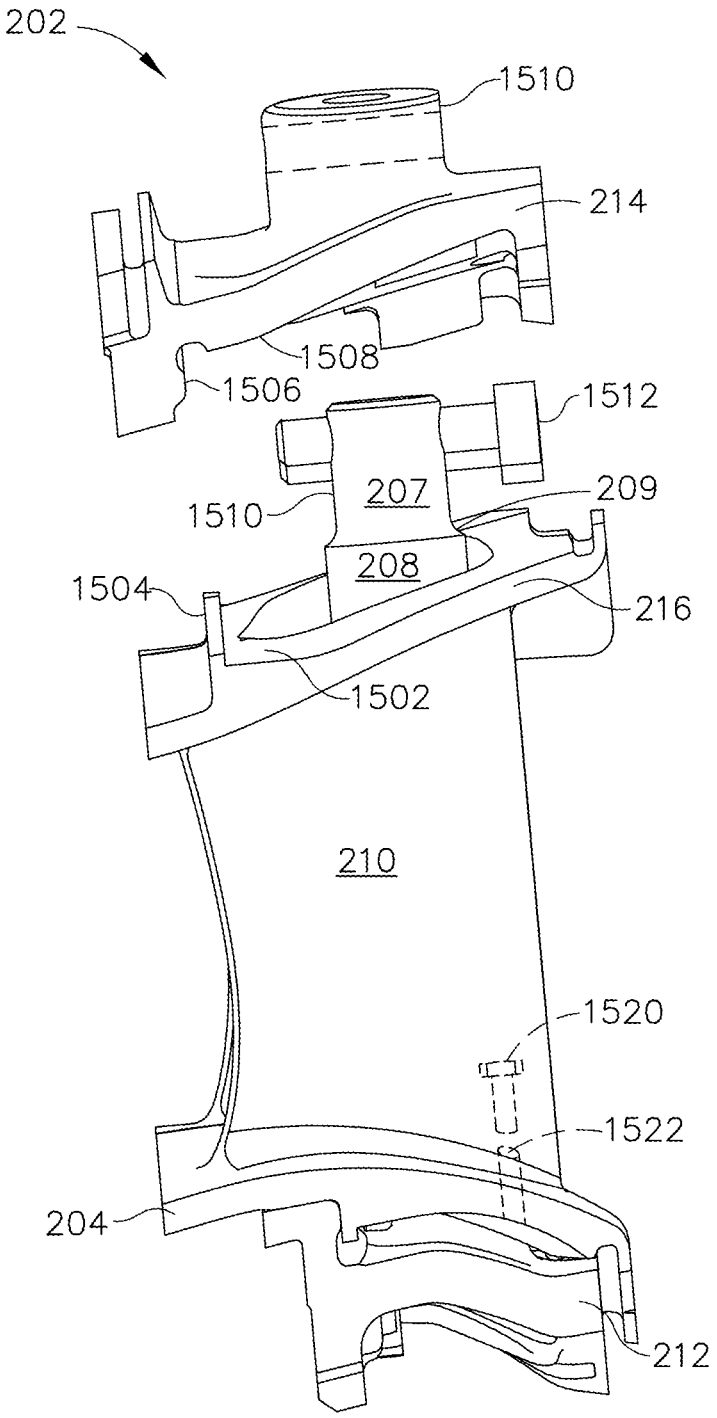
FIG. 16 is another partially exploded view of the nozzle segment assemblies from a side perspective looking circumferentially.

FIG. 15 is a partially exploded view of nozzle segment assemblies 202 in accordance with another example embodiment of the present disclosure from a forward perspective looking aft. FIG. 16 is another partially exploded view of nozzle segment assemblies 202 from a side perspective looking circumferentially. In the example embodiment, nozzle segment assembly 202 includes an inner support structure 212 formed of a first metallic material. Inner support structure 212 includes a strut 208 that is couplable to inner support structure 212, is formed integrally with inner support structure 212, or may be coupled to inner support structure 212 during assembly of nozzle segment assembly 202. Strut 208 may be hollow and may each have at least one internal wall to enhance a stiffness of strut 208. Strut 208 includes a first mating end 206 (hidden by inner support structure 212 in FIGS. 15 and 16), a second opposing mating end 207, and a strut body 209 extending radially therebetween. In the example embodiment, strut body 209 is cylindrically-shaped. In various embodiments, strut body 209 has non-circular cross-section, for example, but, not limited to, oval, oblong, polygonal, or combinations thereof. Nozzle segment assembly 202 also includes a radially outer support structure 214 formed of a second metallic material. In the example embodiment, the first and second metallic material are the same material such as, but not limited to a nickel-based superalloy, an intermetallic material such as gamma titanium aluminide, or other alloy that exhibits resistance to high temperatures. Inner support structure 212, outer support structure 214, strut 208, and other metallic components of the assembly may all be formed of the same material or may be formed of different materials that are able to perform the functions described herein.

Nozzle airfoil 210 is formed of a material having a low coefficient of thermal expansion, such as for example, ceramic matrix composite (CMC) material. Nozzle airfoil 210 extends between inner band 204 and outer band 216. Outer band 216 includes a radially outwardly-extending end surface 302 having an aft facing flange surface 1504 extending radially outwardly from outwardly-facing end surface 1502 and formed integrally with outer band 216. Flange surface 1504 is configured to mate with a complementary flange surface 1506 formed in a radially inner surface 308 of outer support structure 214. A seal between outer band 216 and outer support structure 214 is formed at the mating surfaces of flange surface 1504 and flange surface 1506 when nozzle segment assemblies 202 is assembled.

Nozzle segment assemblies 202 also includes a first radial retention feature 1508 that includes strut body 209, mating end 207, a mating end receptacle 1510, and a first retention pin 1512. When assembled, mating end 207 is inserted into receptacle 1510 such that an aperture 1514 through mating end 207 and an aperture 1516 through mating end receptacle 1510. First retention pin 1512 is inserted through apertures 1514 and 1516 to retain nozzle segment assemblies 202 radially.

Nozzle segment assemblies 202 also includes a second radial retention feature 1518 that includes one or more radial retention pins 1520 and associated apertures 1522 in inner band 204. Radial retention pins 1520 extend from a radial outer side of inner band 204 within hollow airfoil 210, through inner band 204, and into inner support structure 212 using associated apertures 1522. The purpose of these pins is to sandwich inner band 204 to prevent nozzle airfoils 210 from floating radially outwardly due to an a mismatch between strut body 209 and nozzle airfoils 210 causing a radial gap to open. Allowing nozzle airfoils 210 to float in this opened gap would cause undesirable flow path steps. Radial retention pins 1520 ensure that nozzle airfoils 210 are always loaded to inner support structure 212.

Embodiments of the present disclosure have been described and illustrated showing various ways CMC nozzle segment assembly 202 can interface with strut 208, inner support structure 212, and outer band 216, with different configurations having certain benefits or detriments such as sealing, leakage, and stresses. In some embodiments, CMC nozzle segment assembly 202 is mounted to a metal strut to react loads to the stator. The various mounting features include a "wange" or wedge flange, which is a reinforced flange that can transmit axial or tangential load, a "tab" is a feature for transmitting primarily tangential load, a "whistle notch" is a notch or cutout in inner band 204 or outer band 216 and is primarily a tangential load feature, a flange notch, which is also primarily a tangential load feature, a "pad" is a feature inside the nozzle cavity that loads against the strut 208, and a "pin" that is a feature that has holes or slots in inner band 204 or outer band 216 that loads to the strut through the pins.

It will be appreciated that the above embodiments that have been described in particular detail are merely example or possible embodiments, and that there are many other combinations, additions, or alternatives that may be included.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The above-described embodiments of a method and system of transferring load from a ceramic matrix composite (CMC) vane assembly to a metallic vane assembly support member provides a cost-effective and reliable means for spreading load transferred from the CMC vane assembly to the metallic vane assembly support member over a larger area than with traditional metallic vane assemblies. More specifically, the method and system described herein facilitate orienting and positioning load transmitting features on the CMC vane assembly with respect to load receiving features on the metallic vane assembly support member. As a result, the methods and systems described herein facilitate extending a service life of the vane assemblies in a cost-effective and reliable manner.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An airfoil assembly for a gas turbine engine, said airfoil assembly comprising a ceramic matrix composite (CMC) material, said airfoil assembly comprising a forward end and an aft end with respect to an axial direction of the gas turbine engine, said airfoil assembly comprising:

a radially outer end component comprising a radially outwardly-facing end surface having a forward flange on the forward end, an aft flange on the aft end and a non-compression load-bearing feature extending radially outwardly from said outwardly-facing end surface and formed integrally with said outer end component, said non-compression load-bearing feature located in a portion between the forward flange and the aft flange and configured to mate with a complementary feature formed in a radially inner surface of a first airfoil assembly support structure, said non-compression load-bearing feature selectively positioned orthogonally to a force imparted into said airfoil assembly;

a radially inner end component configured to engage a second airfoil assembly support structure positioned radially inward from said radially inner end component; and a hollow airfoil body extending there between, said airfoil body configured to receive a strut couplable at a first end to said first airfoil assembly support structure.

2. The assembly of claim 1, wherein said first airfoil assembly support structure and said second airfoil assembly support structure are composed of a metallic material.

3. The assembly of claim 1, wherein said radially inner end component comprises a radial retention feature comprising a radial retention pin extending through said radially inner end component and into said second airfoil assembly support structure and configured to maintain a loading between the radially inner end component and the second airfoil assembly support structure such that radially inner end component is clamped to second airfoil assembly support structure.

4. The assembly of claim 1, wherein said radially inner end component comprises a radially inwardly-facing end surface having a non-compression load-bearing feature extending radially inwardly from said inwardly-facing end surface and formed integrally with said inner end component, said non-compression load-bearing feature of the radially inwardly-facing surface configured to mate with a complementary feature formed in a radially outer surface of a second airfoil assembly support structure.

5. The assembly of claim 4, wherein said strut is couplable at a second end to said second airfoil assembly support structure.

6. The assembly of claim 1, wherein said non-compression load-bearing feature comprises a notch formed in a wedge-shaped portion of said outwardly-facing end surface.

7. The assembly of claim 1, wherein said non-compression load-bearing feature comprises a wedge-shaped portion of said outwardly-facing end surface positioned orthogonally to the axial direction.

8. The assembly of claim 1, wherein said non-compression load-bearing feature comprises a wedge-shaped portion of said outwardly-facing end surface positioned orthogonally to a circumferential direction approximately orthogonal to the axial direction.

9. The assembly of claim 8, wherein said wedge-shaped portion engages a pivot member configured to rotate about a radially oriented pin that permits the pivot member to maintain face-to-face contact with said wedge-shaped portion when said airfoil assembly experiences a twisting force.

10. The assembly of claim 1, wherein said outwardly-facing end surface comprises a plurality of non-compression load-bearing features, each positioned orthogonally to a predetermined direction of a component of a force imparted to said airfoil assembly when said airfoil assembly is in operation within the gas turbine engine.

11. The assembly of claim 1, wherein said non-compression load-bearing feature comprises an outwardly radially extending tab, said tab configured to engage a complementarily-shaped boss formed in said first airfoil assembly support structure.

12. The assembly of claim 11, wherein said tab and said boss comprise mutually aligned apertures configured to receive a pin therethrough.

13. The assembly of claim 1, wherein said non-compression load-bearing feature comprises a hook member comprising a radially outwardly extending ramp portion and an opposing concave portion.

14. The assembly of claim 1, wherein said outwardly-facing end surface comprises an aperture extending therethrough to an interior of said hollow airfoil body and a pressure-side wedge extending from a pressure-side of said airfoil assembly on said outwardly-facing end surface and terminating at said aperture, said pressure side wedge comprising one or more load pads adjacent said aperture, said one or more load pads configured to receive a complementarily-shaped portion of the first airfoil assembly support structure.

15. A method of transferring load from a ceramic matrix composite (CMC) vane assembly to a metallic vane assembly support member, said method comprising:

providing the CMC vane assembly, the vane assembly including:

a radially outer end component including a radially outwardly facing surface having a forward flange on a forward end, an aft flange on an aft end and one or more radially outwardly extending load transfer features located in a portion between the forward flange and the aft flange;

a radially inner end component; and an airfoil body extending therebetween;

engaging the radially outer end component to at least one of a plurality of metallic vane assembly support members spaced circumferentially about a gas flow path, the vane assembly support members including one or more load receiving features shaped complementary to the load transfer features, the load transfer feature including a wedge-shaped cross-section.

16. The method of claim 15, wherein providing the CMC vane assembly comprises providing the CMC vane assembly that includes a second load transfer feature extending radially outwardly from the radially outwardly facing surface of the radially outer end component.

17. A gas turbine engine comprising:

an inner support structure formed of a first metallic material, said inner support structure comprising a strut, said strut comprising a first mating end, a second opposing mating end and a strut body extending radially therebetween;

an outer support structure formed of a second metallic material;

an airfoil assembly comprising a ceramic matrix composite (CMC) material and extending between said inner support structure and said outer support structure, said airfoil assembly comprising:

a radially outer end component comprising a radially outwardly-facing end surface having a forward flange on a forward end, an aft flange on an aft end and a non-compression load-bearing feature extending radially outwardly from said outwardly-facing end surface and formed integrally with said outer end component, said non-compression load-bearing feature located in a portion between the forward flange and the aft flange and configured to mate with a complementary feature formed in a radially inner surface of said outer support structure, said non-compression load-bearing feature selectively positioned orthogonally to a force imparted into said radially outwardly-facing end surface;

a radially inner end component; and a hollow airfoil body extending therebetween, said airfoil body configured to receive a strut couplable at a first end to said outer support structure.

18. The gas turbine engine of claim 17, wherein said radially inner end component comprises a radially inwardly-facing end surface having a non-compression load-bearing feature extending radially inwardly from said inwardly-facing end surface and formed integrally with said inner end component, said non-compression load-bearing feature of said radially inner end component configured to mate with a complementarily-shaped feature formed in a radially outer surface of said inner support structure, said non-compression load-bearing feature selectively positioned orthogonally to a force imparted into said radially inwardly-facing end surface.

19. The gas turbine engine of claim 17, wherein said non-compression load-bearing feature comprises a wedge-shaped cross-section.

20. The gas turbine engine of claim 17, wherein said non-compression load-bearing feature comprises a tab.

21. The gas turbine engine of claim 17, wherein said non-compression load-bearing feature comprises a notch.

22. A nozzle segment assembly comprising:

an inner support structure formed of a first metallic material, said inner support structure comprising a strut, said strut comprising a first mating end, a second opposing mating end and a strut body extending radially therebetween;

an outer support structure formed of a second metallic material and comprising a radially outwardly extending hollow receptacle configured to receive said second opposing mating end;

an airfoil assembly comprising a ceramic matrix composite (CMC) material and extending between said inner support structure and said outer support structure, said airfoil assembly comprising:

a radially outer end component comprising a radially outwardly-facing end surface having a forward flange on a forward end, an aft flange on an aft end and a non-compression load-bearing feature extending radially outwardly from said outwardly-facing end surface and formed integrally with said outer end component, said non-compression load-bearing feature located in a portion between the forward flange and the aft flange and configured to mate with a complementary feature formed in a radially inner surface of said outer support structure, said non-compression load-bearing feature selectively positioned orthogonally to a force imparted into said radially outwardly-facing end surface, said non-compression load-bearing feature forming a seal along an aft facing flange of the radially outwardly-facing end surface and a forward facing flange of the outer support structure.

23. The nozzle segment assembly of claim 22, wherein said airfoil assembly further comprises:

a radially inner end component; and a hollow airfoil body extending therebetween, said airfoil body configured to receive a strut couplable at a first end to said outer support structure.

24. The nozzle segment assembly of claim 22, wherein said radially outwardly extending hollow receptacle and said second opposing mating end are coupled together using a pin extending through respective apertures in each of said radially outwardly extending hollow receptacle and said second opposing mating end.

* * * * *